US006598869B2

(12) United States Patent
Johnson et al.

(10) Patent No.: US 6,598,869 B2
(45) Date of Patent: Jul. 29, 2003

(54) MEDIA HANDOFF PROTOCOL FOR CONTINUOUS OR START/STOP DEVICE

(75) Inventors: Jon R. Johnson, Vancouver, WA (US); Jeanette M. Coffren, Camas, WA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 09/906,735

(22) Filed: Jul. 18, 2001

(65) Prior Publication Data

US 2003/0015833 A1 Jan. 23, 2003

(51) Int. Cl.[7] ..... B65H 7/02; G06F 13/00

(52) U.S. Cl. ..... 271/3.15; 271/3.17; 271/265.02; 700/228

(58) Field of Search ..... 271/265.01, 265.02, 271/3.15, 3.17; 399/16; 700/228, 229, 230; 198/572

(56) References Cited

U.S. PATENT DOCUMENTS 4,561,060 A * 12/1985 Hemond ..... 700/229
5,105,363 A * 4/1992 Dragon et al. ..... 700/229
5,185,866 A * 2/1993 Francisco ..... 700/228
5,520,383 A * 5/1996 Amagai et al. ..... 271/265.01
5,540,426 A * 7/1996 Nakamura et al. ..... 271/265.01
5,967,506 A * 10/1999 Miki et al. ..... 271/3.17
6,021,888 A * 2/2000 Itoh et al. ..... 198/572
6,311,039 B1 * 10/2001 Funamizu et al. ..... 399/16
6,370,447 B1 * 4/2002 Miyazaki ..... 700/230

* cited by examiner

*Primary Examiner*—John M. Jillions

(57) ABSTRACT

A method of media handoff from a first device to a second device comprises transmitting a first signal from the first device indicating a medium is at a predetermined handoff point. The first device receives a second signal from the second device instructing the first device to transport the medium toward the second device. The first device transports the medium toward the second device and receives a third signal from the second device indicating acceptance of the medium by the second device.

17 Claims, 5 Drawing Sheets

MEDIA HANDOFF PROTOCOL FOR CONTINUOUS OR START/STOP DEVICE

FIELD OF THE INVENTION

The invention relates to media handling devices. In particular, the invention relates to a protocol for media handoff between devices using either continuous or indexed feed.

BACKGROUND

For a processing medium such as paper, the medium may be transported through several media handling devices in a media path. Each of the devices in a media path is provided with a media driver such as rollers. Such media handling devices may include printers, fax machines, scanners, or a variety of other such devices. Typically, the devices are placed substantially adjacent to each other in the media path, allowing automatic handoff from the output of one device to the input of the next device.

Typically, media handling devices in a media path process media in a continuous mode. In such a mode, when one device outputs a medium, the next device in the path accepts that output and continues transporting the medium in a continuous manner. Once the second device begins the process of receiving the medium, no further communications are made between the two devices. Thus, the next device continues to process the medium, and no interruptions in the movement of the medium are allowed. An example of a continuous-mode device is a laser printer. Laser printers process a medium as it continuously moves through the device.

However, a media path may contain a device that requires indexed movement, rather than continuous movement. An example of such a device is an ink jet printer. An ink jet printer typically periodically moves the medium a predetermined amount during the printing operation. While the medium is stopped, the ink jet printer prints on a section of the medium before again moving the medium a predetermined amount. Existing media handling systems do not accommodate handoff between two devices in a media path if one or more of the devices requires indexed movement.

During a handoff, the last set of rollers of one device and the first set of rollers of the next device in the media path typically have control of the media simultaneously for at least some period of time. Certain devices may have releasable rollers that can release the medium once the next device has the medium between its rollers. Thus, once the next device has the medium between its rollers, it transports the medium with no assistance from the previous device. Such operation is hereinafter referred to as "no-assist operation".

Certain devices, however, may not have releasable rollers and may maintain some control over the movement of the medium even after the next device has the medium between its rollers. Thus, the medium may simultaneously be under the control of two separate devices. Such operation is hereinafter referred to as "assisted operation".

The invention provides a handoff protocol that is capable of accommodating handoffs requiring indexed feed. In additional embodiments, the invention provides a protocol which also accommodates continuous-feed handoffs and handoffs with no-assist or assist operation.

SUMMARY OF THE INVENTION

One embodiment of the invention provides a method of media handoff from a first device to a second device comprising transmitting a first signal from said first device indicating a medium at a predetermined handoff point; receiving a second signal from the second device instructing the first device to transport the medium toward the second device; transporting the medium toward the second device; receiving a third signal from the second device indicating acceptance of the medium by the second device; receiving a fourth signal from the second device instructing the first device to transport the medium a predetermined distance; and transporting the medium the predetermined distance.

According to another embodiment of the invention, a media handoff system comprises a first media handling device comprising a first media driver for transporting a medium through the first media handling device and a first controller for controlling the first media driver; and a second media handling device comprising a second media driver for receiving the medium from the first media handling device and transporting the medium through the second media handling device and a second controller for controlling the second media driver and being adapted to communicate with the first controller; wherein the first controller is adapted to receive signals from the second controller and to start or stop the first media driver in response to the signals.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

Figure 1:
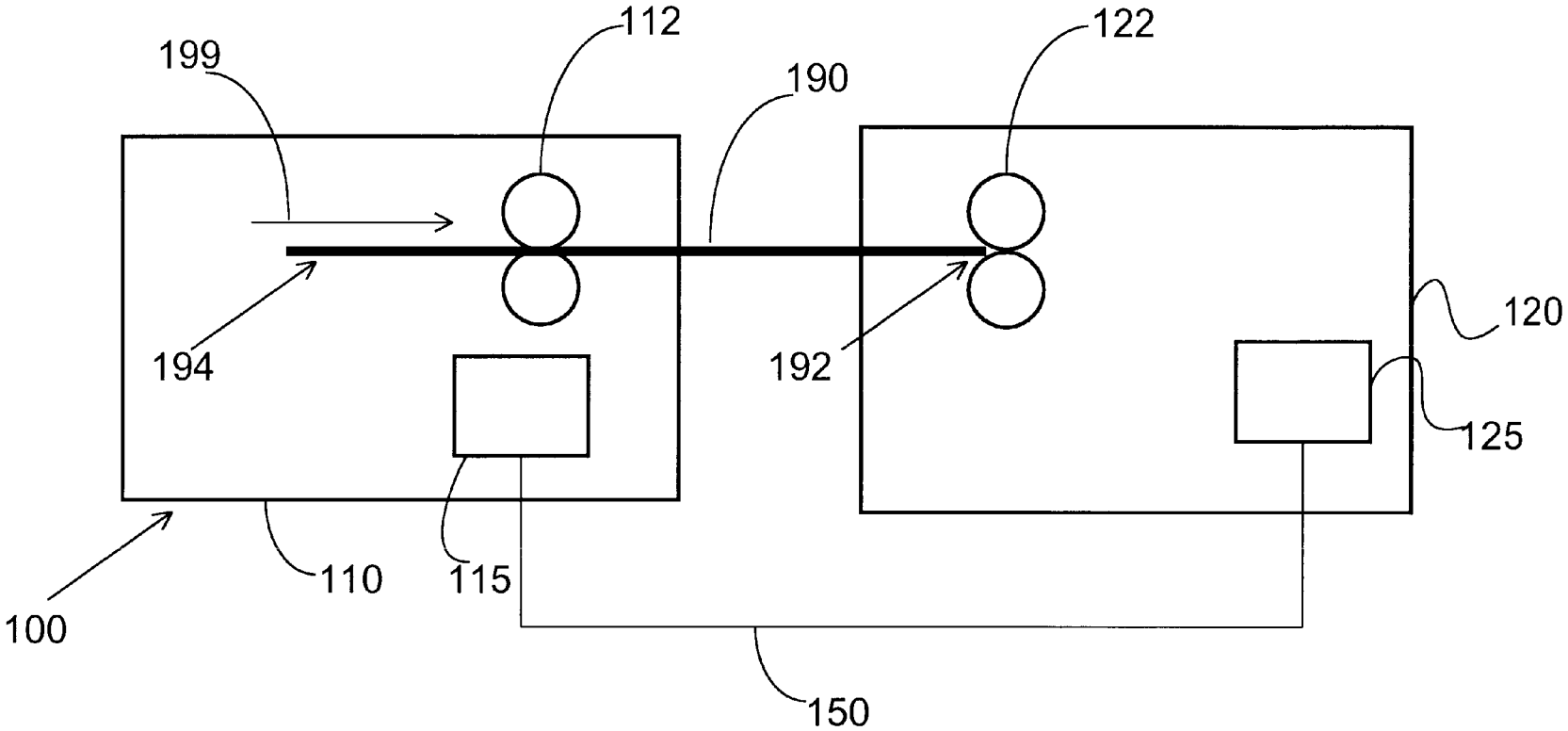
FIG. 1 is a schematic diagram of a media handling system according to one embodiment of the invention.

FIG. 1 illustrates a media handling system capable of operating according to an embodiment of the invention. The media handling system 100 includes a first media handling device 110 and a second media handling device 120. The media handling devices 110, 120 are located close enough to each other to allow handoff of a medium 190, such as paper, mylar or any other convenient medium, from one media handling device to the other. The medium 190 has a leading edge 192 and a trailing edge 194, with the medium 190 being transported in the example from left to right in FIG. 1, as indicated by the arrow 199. Thus, medium 190 is handed off from the first media handling device 110 to the second media handling device 120.

Media handling device 110 is provided with a drive mechanism such as exit rollers 112 driven by a motor or other means to transport the medium 190. In one embodiment the exit rollers 112 may be the last set of rollers in a series of roller sets in media handling device 110. The exit rollers 112 may be releasable so that they may disengage the medium 190. The media handling device 110 also has a controller 115 for controlling the rollers 112 and other aspects of the media handling device 110 such as communication with other devices. Note that the drive mechanism is not limited to rollers, and may take a variety of other forms including air drives, magnetic drives, electrostatic drives and any other convenient drive mechanisms.

The second media handling device 120 has a drive mechanism such as driven entry rollers 122 for receiving the medium 190. In one example, the entry rollers 122 may be the first in a series of roller sets of media handling device 120. The media handling device 120 also has a controller 125 for, among other functions, controlling the movement of the rollers 122. Note that other drive mechanisms may be used in place of the rollers, as noted above.

A communication link 150 is provided between the controller 115 of the first media handling device 110 and the controller 125 of the second media handling device 120. The communication link 150 may take the form of a wire, network connection, or an RF or other signal. Thus, the controllers 115, 125 are capable of communicating with each other via communication link 150. Initially, when a media handling device becomes aware of an approaching medium, it may transmit a "PAGE ANNOUNCE" signal alerting other devices in the media path. For example, prior to the beginning of a handoff, the first handling device 110 may transmit a message to the second media handling device 120. This message may be used for a variety of purposes, including to allow the second media handling device to begin, for example, a warm-up process in preparation for the incoming medium and may allow tailgating of media (i.e., processing media as closely as possible to one another).

Figure 2:
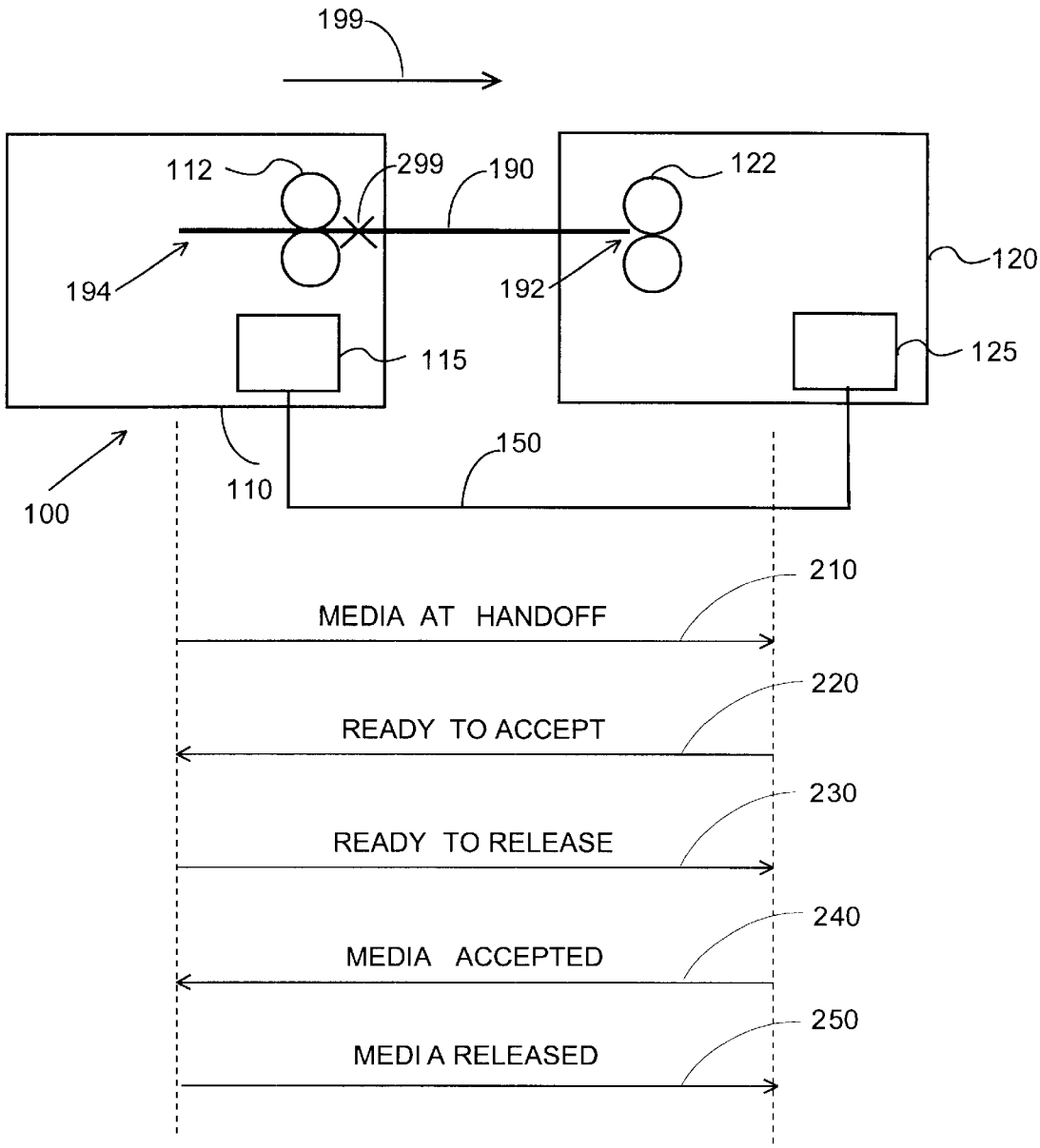
FIG. 2 is a schematic diagram of the operation of a media handling system using indexed feed with no assist.

FIG. 2 illustrates the operation of a media handling system similar to that illustrated in FIG. 1, but using an indexed feed in a no-assist operation. As noted above, indexed feed is required for many devices such as ink jet printers. Such devices require one or more start/stop operations for processing of the media. During a no-assist operation, the upstream device in the handoff has releasable rollers that release the medium when the downstream device has the medium under its control.

Referring now to the operation illustrated in FIG. 2, a series of signals is transmitted between the controllers of the two media handling devices 110, 120. The operation begins when the leading edge 192 of the medium 190 reaches a predetermined handoff point of the first media handling device 110. This point is typically slightly downstream of the last set of rollers or other drive mechanism of the device 110. In FIG. 2, this point is illustrated by reference numeral 299. When the controller 115 of the first media handling device 110 determines that the leading edge 192 of the medium 190 has reached the handoff point 299, the controller 115 transmits a "MEDIA AT HANDOFF" signal 210 to the controller 125 of the second media handling device 120. Note that this determination may be made in any convenient manner, such as for example, through the use of one or more media sensors at or adjacent the handoff point 299. The media sensors may take several forms including optical detectors. When the media handling device 120 is ready for the medium 190 to be fed to its entry rollers 122, it transmits a "READY TO ACCEPT" signal 220 to the controller 115 of the media handling device 110. The controller 115 then causes the exit rollers 112 to transport the medium 190 toward the second media handling device 120 and transmits a "READY TO RELEASE" signal 230 to the controller 125 of the media device 120.

When the controller 125 of the second media handling device 120 determines that the medium 190 has been received by the entry rollers 122 of the second media handling device 120, it transmits a "MEDIA ACCEPTED" signal 240 to the controller 115 of the first media handling device 110. Note again that the determination can be performed in any convenient manner, including by the use of one or more sensors. The controller 115 then causes the releasable exit rollers 112 to release the medium 190. The controller 115 then transmits a "MEDIA RELEASED" signal 250 to the controller 125 of the second media handling device 120. Once the medium 190 is released by the first media handling device 110, the second media handling device 120 begins processing of the media under its exclusive control. Thus, media movement through the first media handling device 110 and the second media handling device 120 may be indexed.

Figure 3:
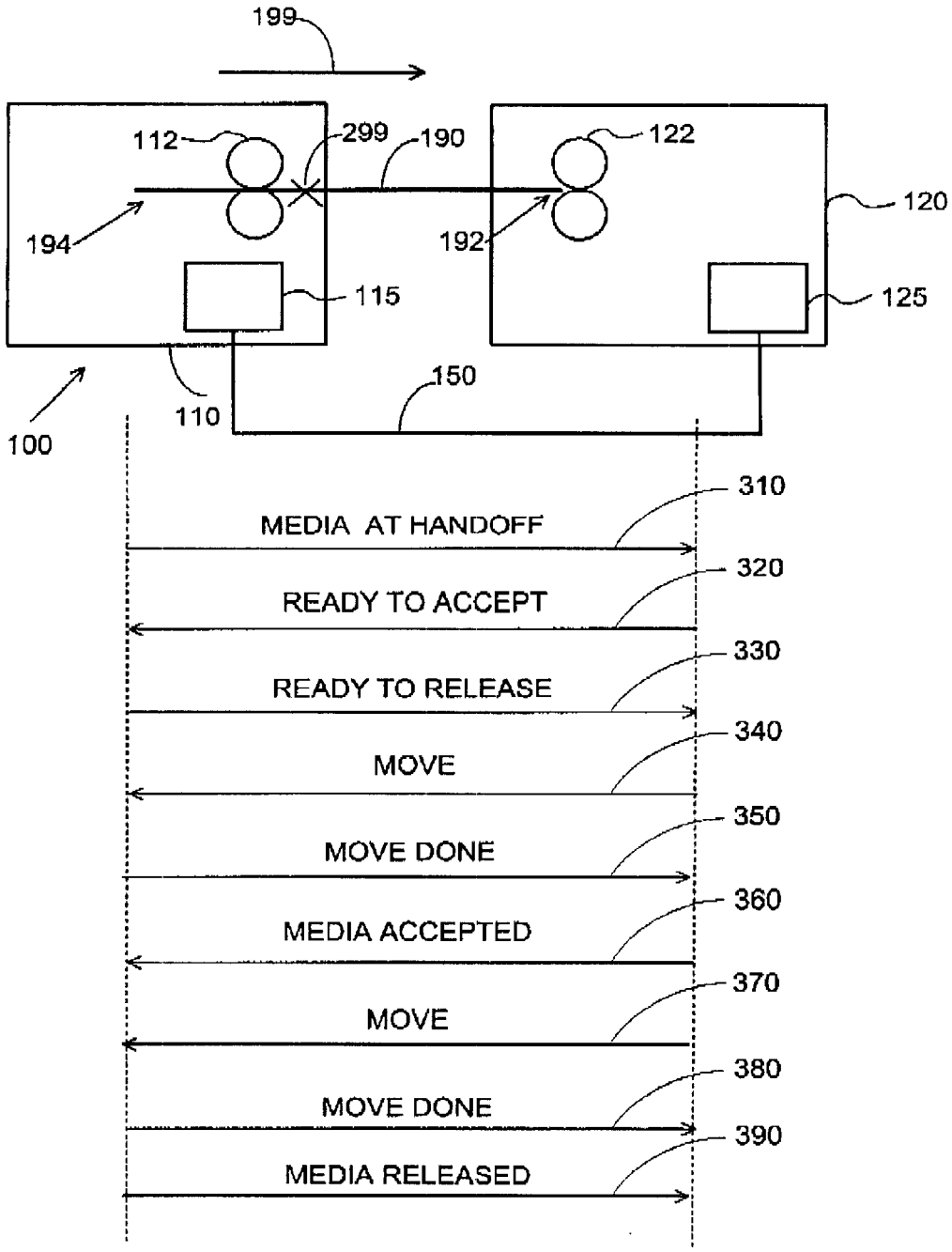
FIG. 3 is a schematic diagram of the operation of a media handling system using indexed feed with assist.

FIG. 3 illustrates the operation of a media handling system similar to that illustrated in FIG. 1 using an indexed feed in an assisted operation. Assisted operation requires two or more devices operating together to transport a medium. Assisted transport may be available and indeed required when, for example, one or more of the devices in the media path has a non-releasable drive mechanism, requiring the drive mechanisms of the two devices to operate together to transport the medium.

Referring now to the operation illustrated in FIG. 3, the operation begins when the leading edge 192 of the medium 190 reaches a predetermined handoff point 299 of the first media handling device 110. When the controller 115 of the first media handling device 110 determines that the leading edge 192 of the medium 190 has reached the handoff point 299, the controller 115 transmits a "MEDIA AT HANDOFF" signal 310 to the controller 125 of the second media handling device 120. When the second media handling device 120 is ready for the medium 190 to be fed to its entry drive mechanism 122, it transmits a "READY TO ACCEPT" signal 320 to the controller 115 of the first media handling device 110. The controller 115 then causes the exit rollers or other drive mechanism 112 to transport the medium 190 toward the second media handling device 120 and transmits a "READY TO RELEASE" signal 330 to the controller 125 of the second media handling device 120. Upon receiving the "READY TO RELEASE" signal 330 from the controller 115, the controller 125 may then cause the entry rollers 122 of the second media handling device 120 to begin moving in preparation for receiving the medium 190.

In one embodiment of an indexed-feed assisted operation, the controller 115 causes the medium 190 to be transported a predetermined length and then stopping, awaiting further instructions from the controller 125 of the second media handling device 120. Before the medium 190 reaches the entry rollers 122 of the second media handling device, the controller 125 may transmit a "MOVE" signal 340 to other devices such as the first media handling device 110. In response to the "MOVE" signal 340, the controller 115 of the first media handling device 110 causes the exit rollers 112 to move and then issues a "MOVE DONE" signal 350 to the controller 125, signaling a completion of that particular movement of the exit rollers 112.

The speed and distance of the movement associated with each "MOVE" signal 340 may be pre-determined or negotiated between the two media handling devices 110, 120. The controller 125 of the second media handling device 120 may issue additional "MOVE" signals as needed for processing of the medium 190. The additional "MOVE" signals may be issued before a "MOVE DONE" signal corresponding to the previous "MOVE" signal is received from the controller 115 of the first media handling device 110.

When the controller 125 determines that the medium 190 has been received by the drive mechanism 122 of the second media handling device 120, it transmits a "MEDIA ACCEPTED" signal 360 to the controller 115 of the first media handling device 110.

While the medium is under control of the drive mechanisms 112 and 122, e.g., both between the entry rollers 122 of the second media handling device 120 and between the exit rollers 112 of the first media handling device, a series of "MOVE" signals 370 may be transmitted by the controller 125 to the first media handling device 110, with corresponding movement of the entry rollers 122. In response to the "MOVE" signals 370, the controller 115 of the first media handling device 110 causes the exit rollers 112 to move and then to issue a "MOVE DONE" signal 350 to the controller 125, signaling a completion of that particular movement of the exit rollers 112. Thus, the movement of the medium 190 may, at least partially through the second media handling device 120, be assisted by the first media handling device 110.

Each "MOVE" signal may be associated with a movement of the media necessitated by, for example, a print engine of the second media handling device 120. The "MOVE" signal may cause the drive mechanisms 112, 122 to move the medium 190 substantially in unison. Alternatively, the "MOVE" signal may cause the intentional creation of a slight buckle in the medium 190. The buckle is created by the drive mechanism 112 of the first media handling device 110 moving the medium 190 prior to movement of the medium 190 by the drive mechanism 122 of the second media handling device 120. The buckle ensures that the medium 190 will be available for movement when the second media handling device 120 is ready to process the medium 190.

When the medium 190 has been transported out of the control of the first media handling device 110 (e.g., out of the exit rollers 112), the controller 115 transmits a "MEDIA RELEASED" signal 390 to the controller 125 of the second media handling device 120.

Figure 4:
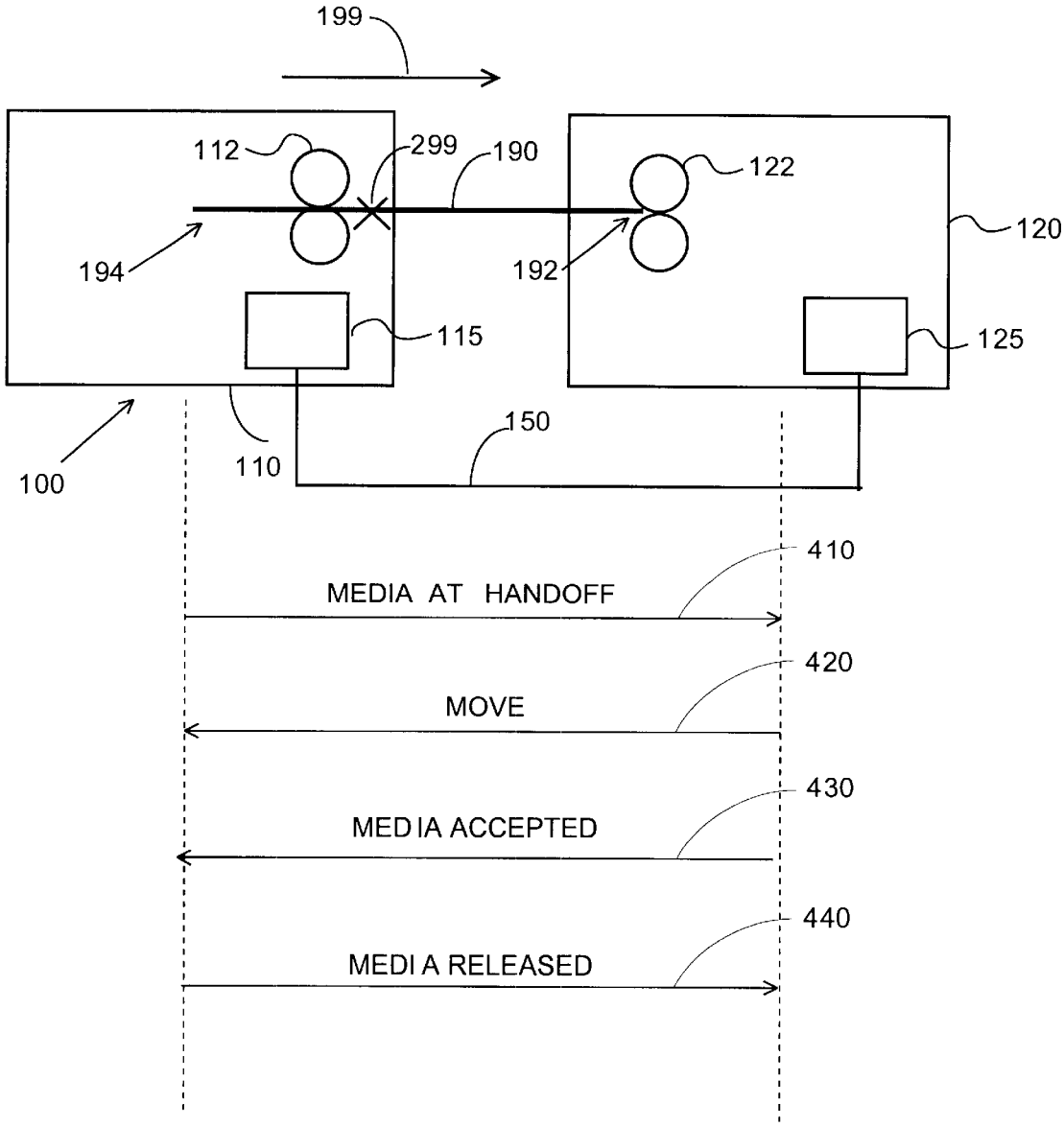
FIG. 4 is a schematic diagram of the operation of a media handling system using continuous feed with assist.

FIG. 4 illustrates the operation of a media handling system similar to that illustrated in FIG. 1 using continuous feed in an assisted operation. Prior to the handoff operation, the first media handling device 110 transports the medium 190 through the device 110. When the leading edge 192 of the medium 190 reaches the handoff point 299, the movement of the medium 190 may be halted, and the controller 115 of the first media handling device 110 transmits a "MEDIA AT HANDOFF" signal 410 to the controller 125 of the second media handling device 120. When the second media handling device 120 is ready for the medium 190 to be fed to its entry rollers 122, it transmits a "MOVE" signal 420 to the controller 115 of the first media handling device 110. The controller 115 then causes the exit rollers 112 to transport the medium 190 toward the second media handling device 120 until the medium 190 has exited the exit rollers 112 of the first media handling device 110.

The second media handling device 120 may transmit the "MOVE" signal 420 prior to receiving the "MEDIA AT HANDOFF" signal 410 from the first media handling device 110. In that instance, the first media handling device 110 will not halt the transportation of the medium 190 but may, nevertheless, transmit the "MEDIA AT HANDOFF" signal 410 when the leading edge 192 reaches the handoff point 299.

When the second media handling device 120 receives the medium 190 between the entry rollers 122, the controller 125 may transmit a "MEDIA ACCEPTED" signal 430 to the controller 115 of the first media handling device 110. This signal, however, may be for information only, as the first media handling device 110, in one embodiment, need not take any action based on the signal.

When the trailing edge 194 of the medium has advanced beyond the drive mechanism, e.g., the exit rollers 112 of the first media handling device 110, the controller 115 transmits a "MEDIA RELEASED" signal to the controller 125 of the second media handling device 120.

The type of handoff between two particular devices may be previously negotiated between the controllers of the two devices. For example, when the devices are initially installed in the media path or are connected via the communication link, the controllers may negotiate that the handoff will be performed using an assisted operation for an indexed feed. Thus, during subsequent handoffs, the upstream device will await certain signals from the downstream device and will respond accordingly. Similarly, the movement speed of the medium during the handoff may be negotiated. Certain signals such as the "PAGE ANNOUNCE", "READY TO ACCEPT", or "MOVE" signals may be accompanied with parameters providing the other devices desired values for those parameters. Such parameters may include the movement speed of the medium during handoffs.

In other embodiments, the negotiation of the handoff may take the form of a hierarchical system that designates a master and a slave according to the requirements of the devices. For example, if one of the devices in the handoff requires assisted operation while the other does not, the device requiring assisted operation may be designated as a master. The master device then supplies the necessary parameters for the handoff to the slave device. As a further example, if one device is a print engine and the other is a media input/output device, the print engine may be declared as the master. In another embodiment, the downstream device may always be designated as the master while the upstream device is the slave.

Figure 5:
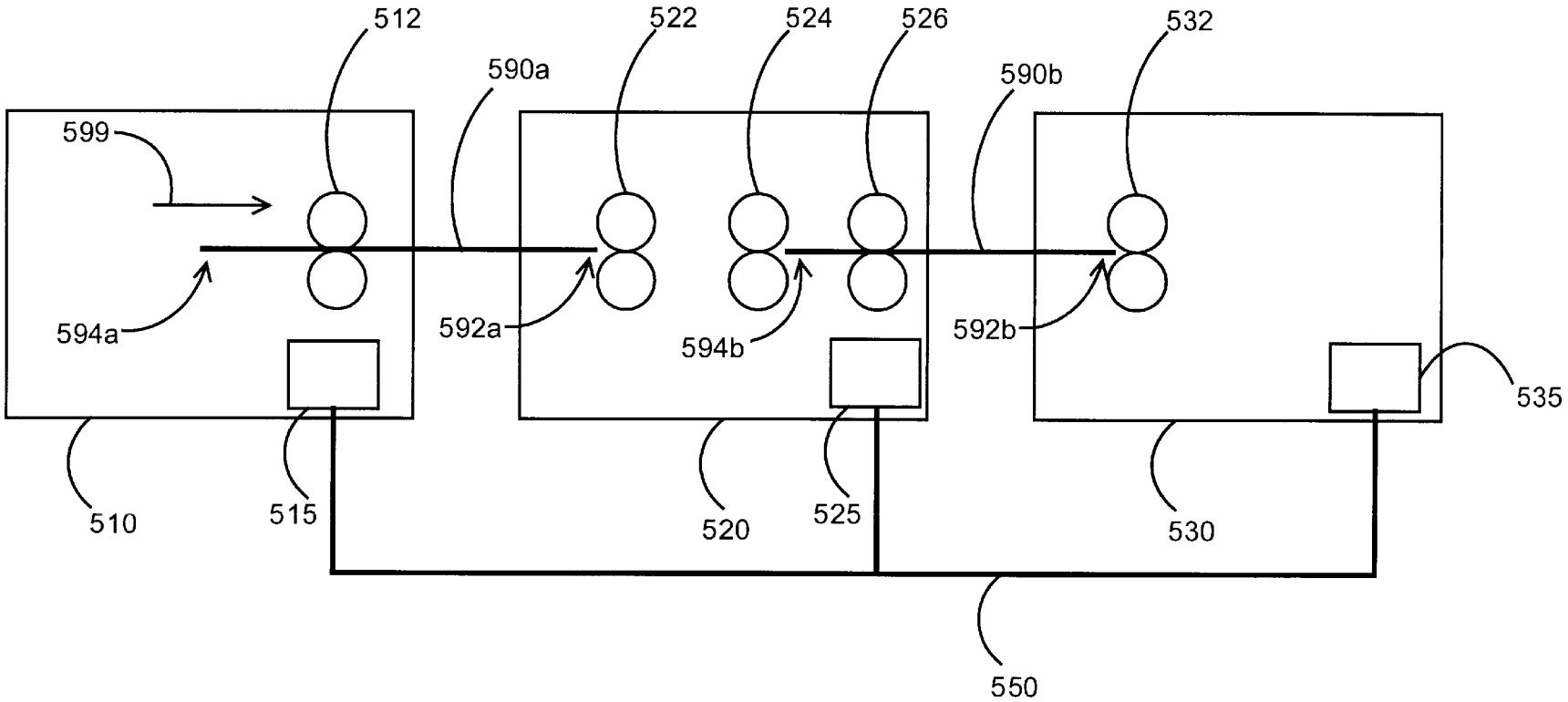
FIG. 5 is a schematic diagram of a media handling system according to another embodiment of the invention.

In other embodiments, the media path may include a series of media processing devices. For example, as illustrated in FIG. 5, three such devices may be placed in a series, forming a media path. An input machine 510, a processing machine 520 and an output machine 530 each have a controller 515, 525, 535. The controllers are linked by a communication link 550. The input machine 510 has an exit drive mechanism 512, and the output machine 530 has an entry drive mechanism 532. The intermediate processing machine 520 is shown with a plurality of drive mechanisms including entry drive mechanism 522, intermediate drive mechanism 524, and exit drive mechanism 526.

The handoff of a medium from the input machine 510 to the processing machine 520, and the handoff from the processing machine 520 to the output machine 530, may be performed similarly to the handoffs described above with reference to FIGS. 2–4.

Thus, a media handoff protocol according to the present invention allows handoff of a medium between two media handling devices under the control of separate controllers for either continuous or indexed feed. Additionally, a system according to the invention may accommodate either assisted or unassisted transport of the medium.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

What is claimed is:

1. A method of media handoff from a first device to a second device, comprising:

transmitting a first signal from said first device indicating a medium at a predetermined handoff point;

receiving a second signal from said second device instructing said first device to transport said medium toward said second device;

transporting said medium toward said second device;

receiving a third signal from said second device indicating acceptance of said medium by said second device;

receiving a fourth signal from said second device instructing said first device to transport said medium a predetermined distance; and transporting the medium said predetermined distance.

2. A method according to claim 1, further comprising:

releasing said medium from said first device before said medium has exited said first device.

3. A method according to claim 1, further comprising:

transmitting a fifth signal from said first device upon completion of said transporting the medium said predetermined distance.

4. A method according to claim 1, further comprising:

designating one of said first device and said second device as a master device and another of said first device and said second device as a slave device, said master device transmitting instructions to said slave device.

5. A method according to claim 4, wherein said designating designates according to a hierarchy.

6. A method of media handoff from a first device to a second device, comprising:

receiving a first signal from said first device indicating a medium at a predetermined handoff point;

transmitting a second signal from said second device instructing said first device to transport said medium to said second device;

transmitting a third signal from said second device indicating acceptance of said medium by said second device; and transmitting a fourth signal from said second device instructing said first device to transport the medium a predetermined distance.

7. A method according to claim 6, further comprising:

receiving a fifth signal from said first device upon transporting of the medium said predetermined distance by said first device.

8. A method according to claim 6, further comprising:

designating one of said first device and said second device as a master device and another of said first device and said second device as a slave device, said master device transmitting instructions to said slave device.

9. A method according to claim 8, wherein said designating designates according to a hierarchy.

10. A media handoff system, comprising:

a first media handling device comprising:

a first media driver for transporting a medium through said first media handling device; and a first controller for controlling said first media driver; and a second media handling device comprising:

a second media driver for receiving the medium from said first media handling device and transporting said medium through said second media handling device; and a second controller for controlling said second media driver and being adapted to communicate with said first controller;

wherein said first controller is designed to receive signals from said second controller and to start or stop said first media driver while said medium is being transported through said second media handling device in response to said signals.

11. The media handoff system according to claim 10, wherein at least one of said first media handling device and said second media handling device is a printer.

12. The media handoff system according to claim 10, wherein at least one of said first media driver and said second media driver is a set of rollers.

13. The media handoff system according to claim 10, wherein said medium is a sheet of paper.

14. A program product, comprising machine readable program code for causing a machine to perform following method steps:

transmitting a first signal from a first device indicating a medium at a predetermined handoff point;

receiving a second signal from a second device instructing said first device to transport said medium toward said second device;

transporting said medium toward said second device;

receiving a third signal from said second device indicating acceptance of said medium by said second device;

receiving a fourth signal from said second device instructing said first device to transport the medium a predetermined distance; and transporting the medium said predetermined distance.

15. The program product according to claim 14, wherein said program code causes a machine to further perform the following method step:

transmitting a fifth signal from said first device upon completion of said transporting the medium said predetermined distance.

16. A program product, comprising machine readable program code for causing a machine to perform following method steps:

receiving a first signal from a first device indicating a medium at a predetermined handoff point;

transmitting a second signal from a second device instructing said first device to transport said medium to said second device;

transmitting a third signal from said second device indicating acceptance of said medium by said second device; and transmitting a fourth signal from said second device instructing said first device to transport the medium a predetermined distance.

17. The program product according to claim 16, wherein said program code causes a machine to further perform the following method step:

receiving a fifth signal from said first device upon transporting of the medium said predetermined distance by said first device.

* * * * *